US009492007B1

(12) United States Patent
Lin

(10) Patent No.: US 9,492,007 B1
(45) **Date of Patent: *Nov. 15, 2016**

(54) TABLE HINGE AND FOLDING MECHANISM

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd. (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/166,728

(22) Filed: May 27, 2016

Related U.S. Application Data

(63) Continuation of application No. 14/800,935, filed on Jul. 16, 2015, now Pat. No. 9,380,862.

(51) Int. Cl.
*A47B 3/083* (2006.01)
*A47B 3/087* (2006.01)
*A47B 3/08* (2006.01)

(52) U.S. Cl.
CPC ..... *A47B 3/087* (2013.01); *A47B 3/0809* (2013.01)

(58) Field of Classification Search
CPC ..... A47B 3/087
USPC ..... 108/129, 130, 131, 132, 115, 162, 167, 108/168, 169, 171, 172, 173, 174; 292/171
See application file for complete search history.

(56) References Cited

U.S. PATENT DOCUMENTS 833,024 A 10/1906 Clark et al.
1,552,690 A * 9/1925 Frantz ..... E05B 53/003 292/171
1,958,980 A * 5/1934 Vaughan ..... A47B 3/0815 16/326
2,046,790 A * 7/1936 Phillips ..... E05C 17/446 292/142
2,772,935 A * 12/1956 Read ..... A47B 3/087 108/169
2,871,076 A * 1/1959 Mell ..... A47B 3/087 108/36
3,096,732 A * 7/1963 Wilkinson ..... A47B 3/0815 108/127
4,026,221 A * 5/1977 Wilson ..... A47B 3/087 108/169
4,605,250 A * 8/1986 Simo-Company .... E05C 17/446 292/171

(Continued)

FOREIGN PATENT DOCUMENTS

EP 2255694 A 12/2010

*Primary Examiner* — Matthew Ing
(74) *Attorney, Agent, or Firm* — Luedeka Neely Group, P.C.

(57) ABSTRACT

A table has first and second tabletop halves. A leg assembly is mounted to each half and collapses independently of the other and is movable between an extended position and a stowed position. A locking hinge pivotally connects the halves and automatically disengages a locking feature of the hinge when one of the leg assemblies is pivoted. The hinge includes first and second hinge members. The second hinge member includes a pawl pin slot and a pawl pin, which slides in the slot between a first position and a second position. Rotation of the first hinge member with respect to the second hinge member is prevented in the first position and is permitted in the second position. A cable is mounted between the leg assembly and the pawl pin. Pivoting the leg assembly causes the pawl pin to be automatically moved from the first position to the second position.

11 Claims, 7 Drawing Sheets

(56) References Cited

U.S. PATENT DOCUMENTS

| | | | | |
|---|---|---|---|---|
| 6,394,005 | B1 * | 5/2002 | Isensee | A47B 3/0815 108/132 |
| 7,278,361 | B2 * | 10/2007 | Zhurong | A47B 3/0912 108/132 |
| 7,461,601 | B2 * | 12/2008 | Jin | A47B 3/087 108/132 |
| 8,413,594 | B2 * | 4/2013 | Ensley | A47B 3/0815 108/132 |
| 8,555,789 | B2 * | 10/2013 | Jin | 108/129 |
| 2002/0092445 | A1 * | 7/2002 | Glover | A47B 3/087 108/129 |
| 2007/0272128 | A1 * | 11/2007 | Lin | A47B 3/08 108/115 |
| 2008/0178778 | A1 * | 7/2008 | Koning | A47B 3/0818 108/132 |
| 2011/0203493 | A1 * | 8/2011 | Ashby | A47B 3/0818 108/127 |
| 2013/0025509 | A1 * | 1/2013 | Jin | A47B 3/087 108/166 |
| 2014/0116301 | A1 * | 5/2014 | Tsai | A47B 3/087 108/169 |

* cited by examiner

TABLE HINGE AND FOLDING MECHANISM

CROSS-REFERENCE TO RELATED APPLICATIONS

This application is a continuation of application Ser. No. 14/800,935, entitled "Table Hinge & Folding Mechanism", filed Jul. 16, 2015. The contents of the '935 application are incorporated herein by reference.

FIELD

The present invention relates to a hinge for a foldable table, and more particularly to a hinge for a center-folding table having a latch that is operated automatically by rotating a leg of the foldable table.

BACKGROUND AND SUMMARY

A conventional table is available for providing a support effect, thereby facilitating the user using the table. However, the conventional table has a fixed structure and cannot be folded when not in use, thereby increasing space of storage, and thereby causing inconvenience in storage, package and transportation.

An objective of the present invention is to provide a foldable table that is supported rigidly and stably when being expanded and is folded when not in use, thereby enhancing the versatility of foldable table. Another objective of the present invention is to provide a foldable table having a hinge.

A further objective of the present invention is to provide a foldable table that is folded when not in use, thereby saving space of storage, package and transportation.

Another objective of the present invention is to provide a foldable table having a hinged connection between adjacent table top surfaces that includes a latch that may be placed into a stowed or a use position and wherein the latch is operated automatically by rotating one of the legs table.

In accordance with the present invention, there is provided a collapsible table having a first tabletop half and a second tabletop half. The first and second tabletop halves each have a substantially planar top surface, a bottom surface opposite the top surface, an inner edge, and an opposing outer edge which is substantially parallel to the inner edge. There are first support tubes disposed along a first edge of each of the first and second table top halves, which are mounted to the bottom surface thereof. Also, second support tubes spaced apart from the first support tubes are disposed along a second edge of each of the first and second table top halves and mounted to the bottom surface thereof.

The table also includes a collapsible leg assembly having a crossbar pivotally mounted between the first and second support tubes of each of the first and second table top halves. Each leg assembly is operable to collapse independently of the other leg assembly and is movable between an extended position and a stowed position.

The table also includes a locking hinge assembly for pivotally connecting together the first and second table top halves and for automatically disengaging a locking feature of the hinge assembly when at least one of the collapsible leg assemblies is moved from the extended position to the stowed position. In particular, the hinge assembly includes a first hinge member and a second hinge member. Each is mounted to one of the first support tubes. The second hinge member has a pawl pin slot configured to receive a pawl pin.

Additionally, a third hinge member and a fourth hinge member are each mounted to one of the second support tubes. A hinge pin or rod pivotally connects the first and second hinge members together and pivotally connects the third and fourth hinge members together.

A pawl pin is positioned in the pawl pin slot and slides in the slot between a first position and a second position. The pawl pin engages a notch of the first hinge member in the first position and prevents rotation of the first hinge member with respect to the second hinge member. The pawl pin disengages the notch of the first hinge member in the second position and allows rotation of the first hinge member with respect to the second hinge member. A spring member having spring arms engages the pawl pin and biases it toward the first position.

The locking hinge assembly includes a cable having a first end and a second end. The first end of the cable is configured to be fixedly mounted to a portion of the at least one collapsible leg assembly and the second end of the cable is configured to be fixedly mounted to the pawl pin. Pivoting the at least one collapsible leg assembly from an extended position to a stowed position causes the pawl pin to be automatically moved from the first position to the second position. Thereby disengaging the pawl pin from the notch of the first hinge member and allowing rotation of the first hinge member with respect to the second hinge member.

Further benefits and advantages of the present invention will become apparent after a careful reading of the detailed description with appropriate reference to the accompanying drawings.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

The following disclosure relates to a center-folding table having a locking center hinge and collapsible legs or support members. The center-folding table may be placed in an extended or use position and also in a stowed position. In the use position, the locking hinge located between two tabletop halves ensures that the table is not inadvertently collapsed. The present invention allows this locking hinge to be disengaged automatically by simply rotating one of the support stands from the extended position to the stowed position. The locking hinge may be engaged by rotating the support stand from the stowed position to the extended position.

Figure 1:
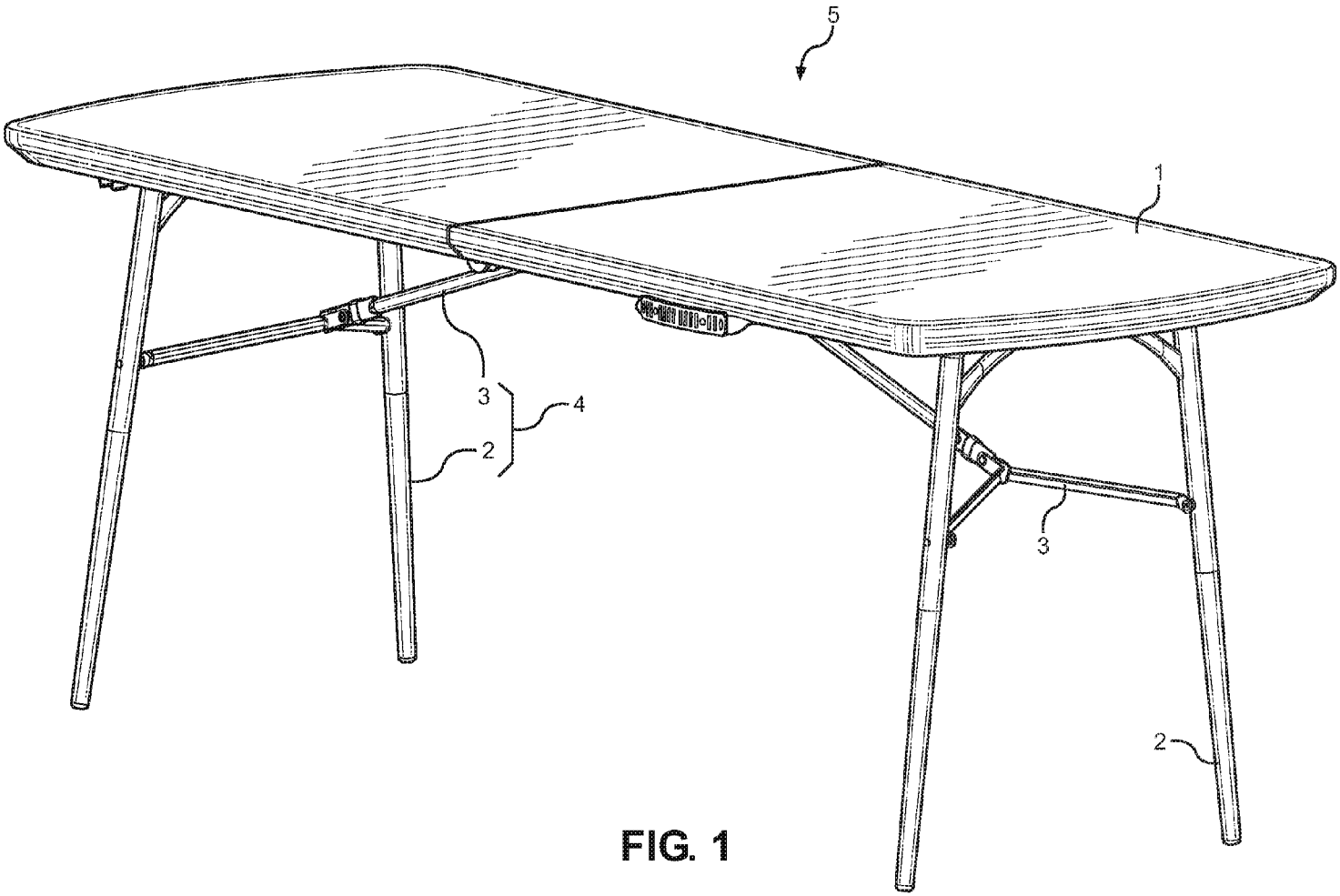
FIG. 1 is a perspective view of a foldable table with collapsible legs and a hinge assembly according to an embodiment of the present invention.
Figure 2:
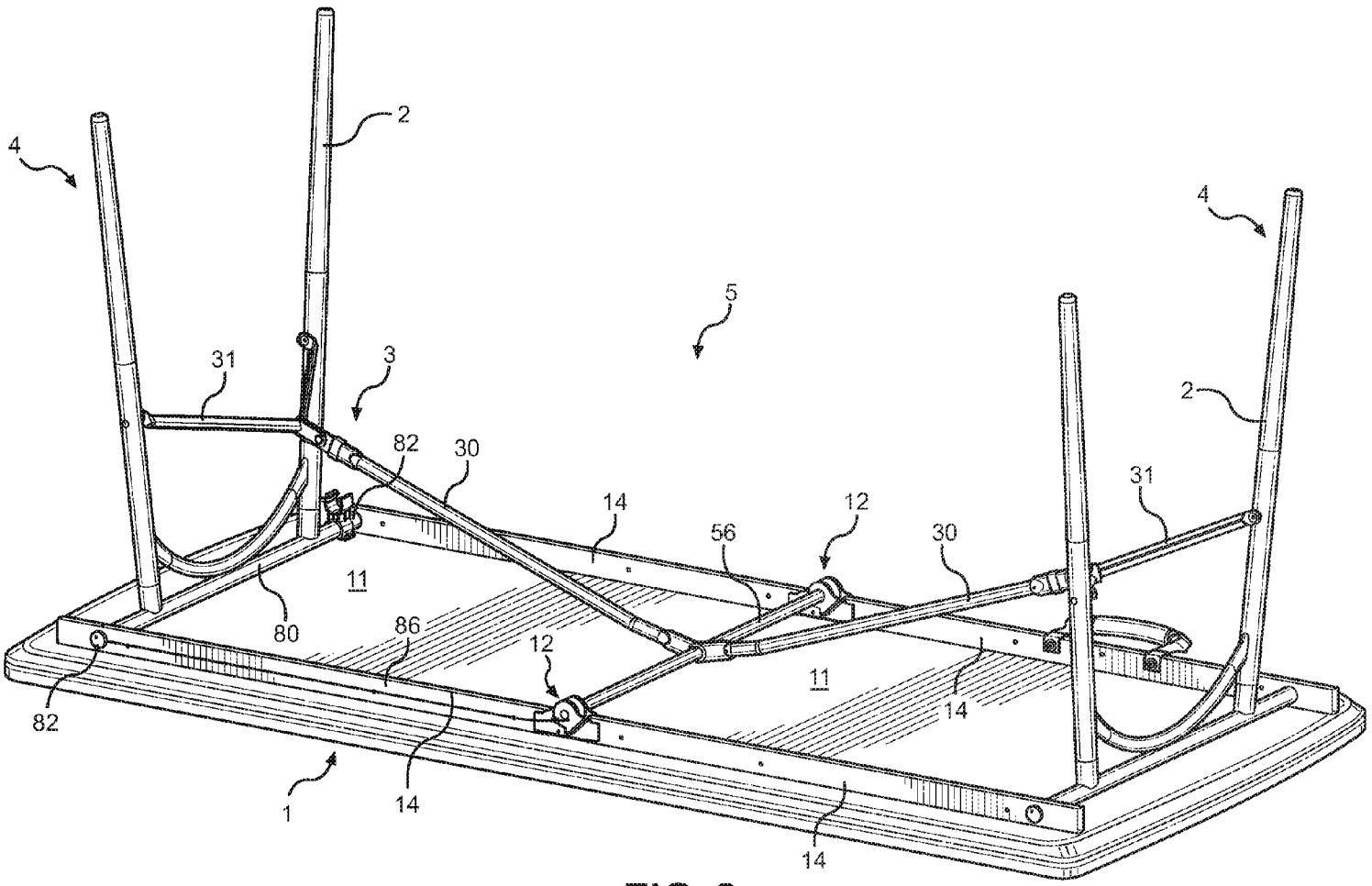
FIG. 2 is a perspective view of a bottom surface of the table depicted in FIG. 1 with support units shown in an extended position.

Referring to the drawings, there is provided in FIGS. 1 and 2 a center-folding table 5 in accordance with one embodiment of the present invention. The table 5 comprises two table boards 1 pivotally connected with each other. Each of the two table boards 1 has a bottom formed with a receiving space 11. The receiving space 11 of each of the two table boards 1 has two sides each provided with a support tube 14 secured on each of the two table boards 1 by a plurality of screws.

Figure 5:
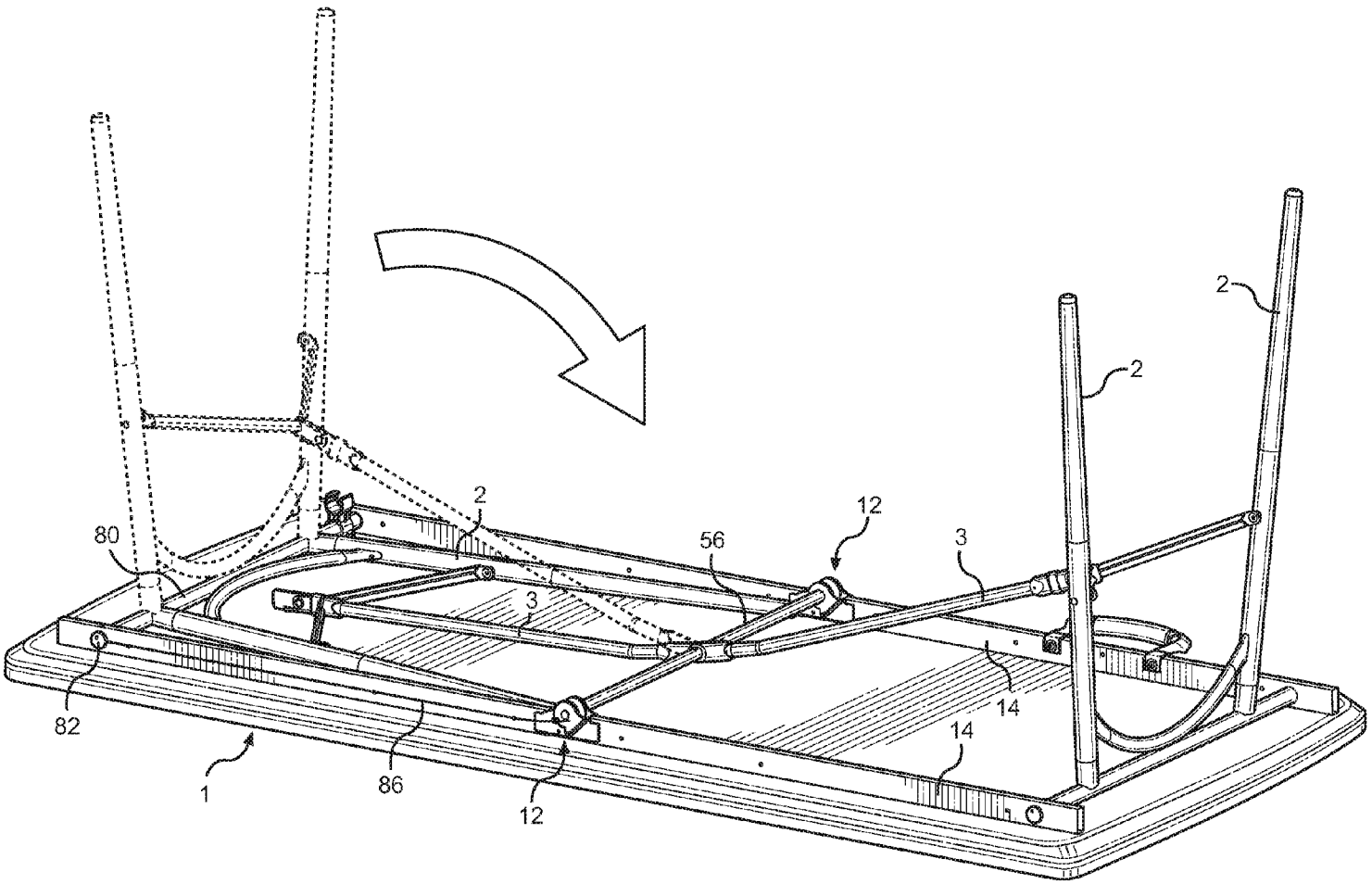
FIG. 5 is a perspective view of the foldable depicted in FIG. 1 with one support unit shown in a stowed position.
Figure 8:
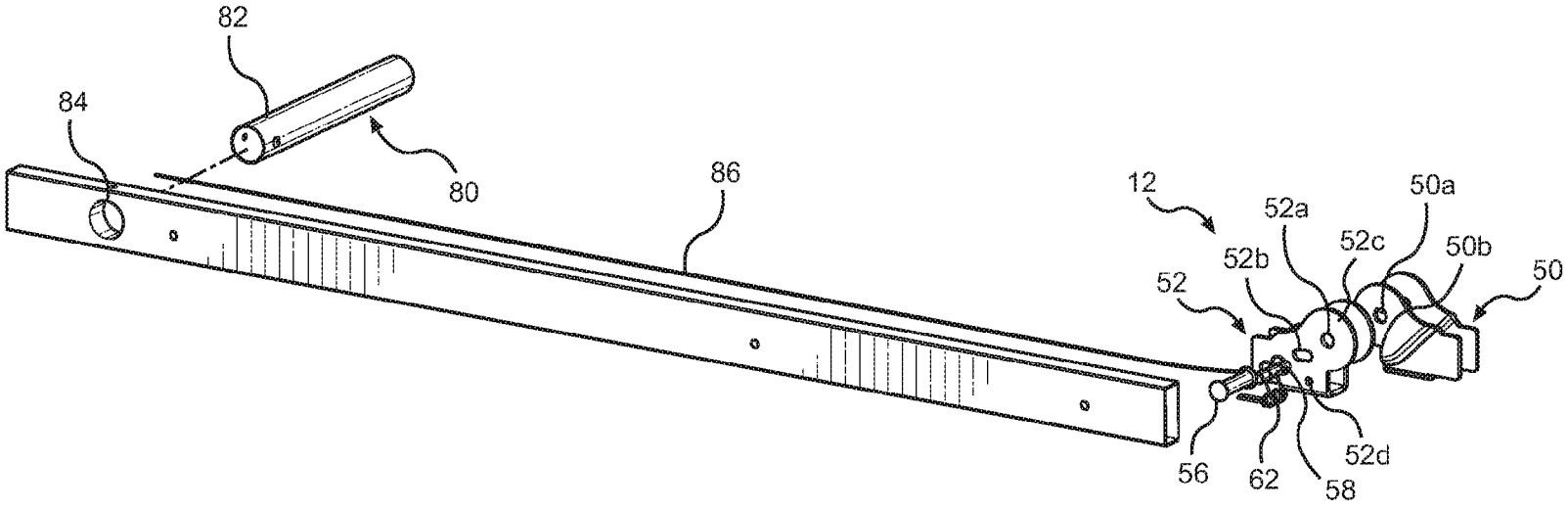
FIG. 8 is an exploded view depicting the hinge assembly shown in FIG. 2.

The table 5 also includes two support units 4, which are each foldably mounted on a respective one of the two table boards 1. Each of the support units 4 includes a support stand 2 that is mounted in the receiving space 11 of a respective one of the two table boards 1. As shown in FIGS. 2, 5 and 8, each support stand 2 has a crossbar member 80 that spans the width of the table 5 and has opposing ends 82 that extend through openings 84 in the support tubes 14. The openings 84 are sized and configured to permit the crossbar 80 to rotate within the opening.

Each support unit 4 also includes a support member 3, which includes a substantially straight support bar 30 mounted to a substantially V-shaped extension bar 31. The opposite end of the extension bar 31 is pivotally mounted at a mediate portion of the support stand 2. The opposite end of the support bar 30 is pivotally mounted to a portion of a hinge assembly 12 connecting the two table boards 1, as discussed below. The support units 4 are configured to rotate from an extended position, shown in FIG. 2, to a stowed position, shown in FIG. 5.

Figure 9:
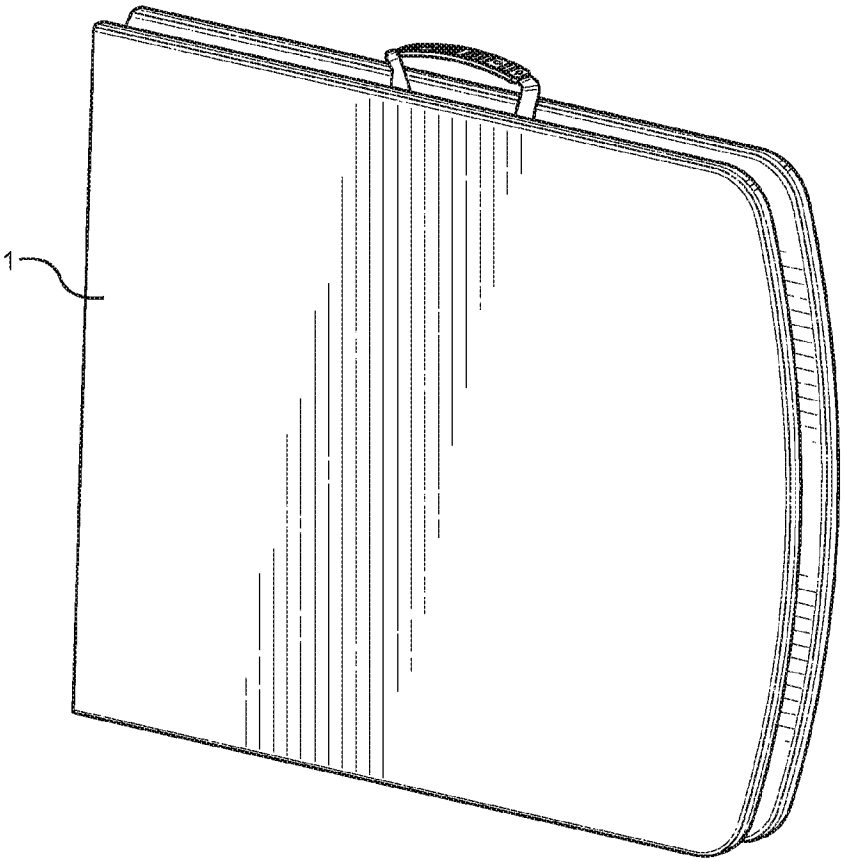
FIG. 9 is a perspective view of the foldable table depicted in FIG. 1 in a closed position.

The two table boards 1 are pivotally connected with each other by two pivot members 12, which are also referred to herein as hinge assemblies 12, and are configured to rotate from an extended position, shown in FIG. 1, to a stowed position, shown in FIG. 9. As shown in FIGS. 2, 5 and 8, each of the hinge assemblies 12 includes two hinge members 50 and 52 pivotally connected together by a hinge pin 56 which passes through apertures 50*a* and 52*a* in circular tabs 50*c* and 52*c* of the hinge members 50 and 52. A single pin 56 spans the width of the table, along the intersection of the two table boards 1, and an end of the pin connects together each of the hinge assemblies 12. The support bar 30 mentioned above is pivotally mounted to the pin 56.

On either side of the hinge member 52 are slots 52*b* through which passes a pawl pin 58. The pawl pin 58 also passes through slots 52*b* on either side of the hinge member 52. The pawl pin 58 is operable to slide laterally in the slots 52*b* between a first position and a second position. As shown best in FIG. 4, in the first position, the pawl pin 58 engages notches 50*b* in the tabs 50*c* of the hinge member 50, thereby preventing rotation of the hinge member 50 with respect to the hinge member 52. In the second position, shown in FIG. 7, the pawl pin 58 disengages the notches 50*b*, thereby allowing rotation of the hinge member 50 with respect to the hinge member 52.

A spring 62 is connected to the hinge member 52 by way of a spring pin 60. The spring pin 60 passes through apertures 52*d* in the hinge member 52 (FIG. 8) and through a coil 62*c* formed in the spring 62. The spring 62 has spring arms 62*a* extending from the coil 62*c* that engage the pawl pin 58. Due to tension in the coil 62*c*, the spring arms 62*a* constantly press against the pawl pin 58, thereby urging the pawl pin 58 toward the first position in the slots 52*b*.

The table 5 also includes a cable 86, which is disposed along the length of one of the table boards 1 parallel with the respective support tube 14 and connects the pawl pin 58 to the crossbar 80. The cable 86 enables the pawl pin to be moved from the first position to the second position automatically (and vice versa) when the support stand 2 is rotated.

Figure 3:
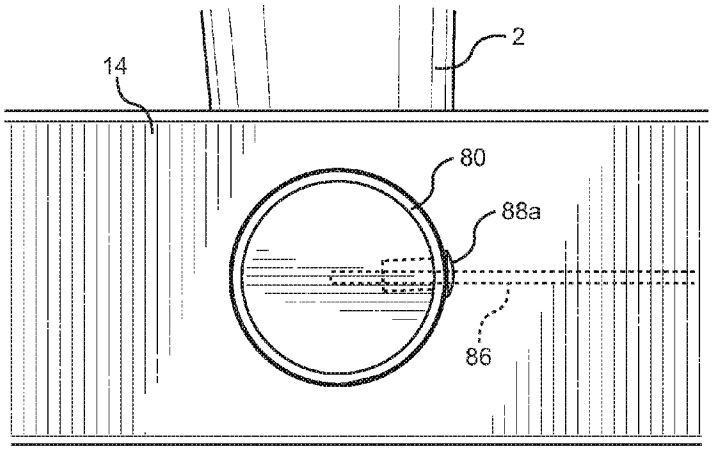
FIG. 3 is an enlarged side view of a first end of the hinge assembly depicted in FIG. 2.
Figure 4:
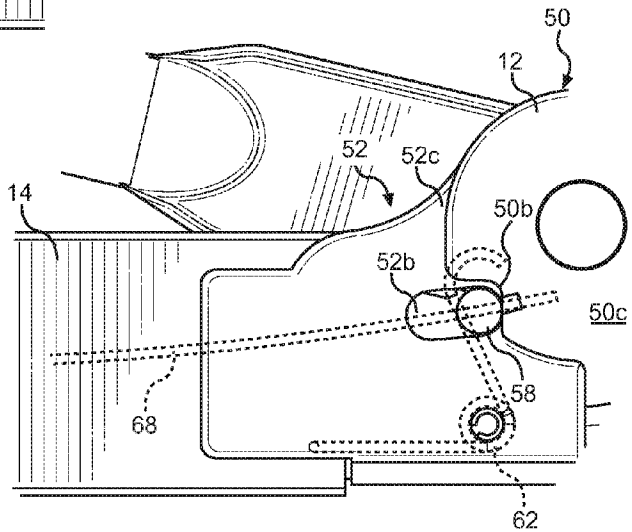
FIG. 4 is an enlarged side view of a second end of the hinge assembly depicted in FIG. 2.
Figure 6:
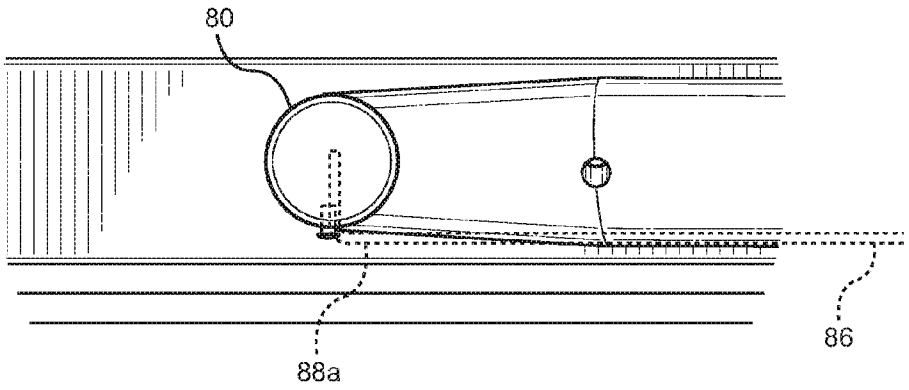
FIG. 6 is an enlarged side view of a first end of the hinge assembly depicted in FIG. 5.
Figure 7:
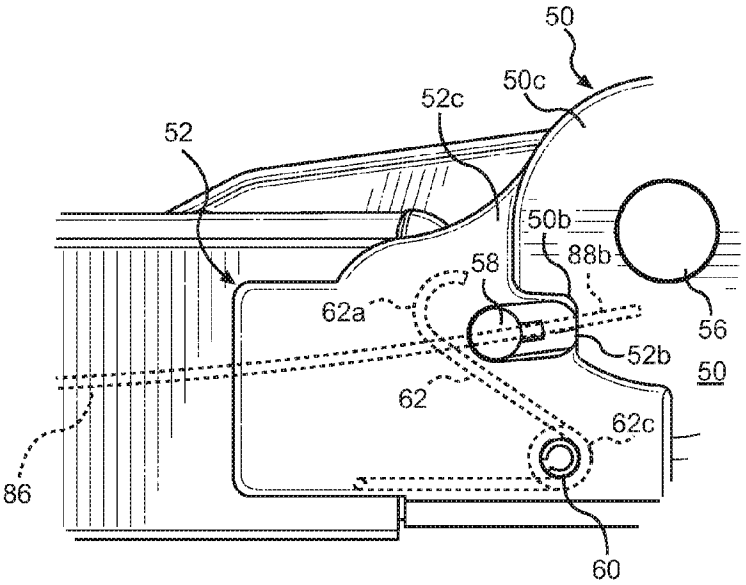
FIG. 7 is an enlarged side view of a second end of the hinge assembly depicted in FIG. 5.

As shown in FIGS. 6 and 7, the cable 86 includes a first end 88A and a second end 88B. The first end 88A is mounted to the crossbar member 80 proximate one of the ends 82. The cable 86 is fixedly mounted to the crossbar member 80, such that rotational movement of the crossbar also causes the first end 88A of the cable to move. As shown in FIG. 2-4, when the support stand 2 is in an extended position, the end 88A of the cable 86 is disposed along a rightward-facing surface of the crossbar 80, the pawl pin 58 is in the first position engaging the notch 50*b*, and rotation of the hinge members 50 and 52 with respect to one another is prevented. On the other hand, as shown in FIGS. 5-7, when the support stand 2 is in a stowed position, the end 88A of the cable 86 is disposed along a downward-facing surface of the crossbar 80, the pawl pin 58 is in the second position not engaging the notch 50*b*, and rotation of the hinge members 50 and 52 with respect to one another is permitted. Accordingly, the pawl pin 54 may be disengaged automatically by simply rotating one of the support stands 2 from an extended position to a stowed position and engaged by rotating the support stand from the stowed position to the extended position.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A table and locking hinge assembly for pivotally connecting together table top halves and for automatically disengaging a locking feature of the hinge assembly when a table leg is pivoted from an extended position to a stowed position, the assembly comprising:

a table comprising:

first and second table top halves, each table top half having a first side frame member mounted to the table top half and disposed along a first edge thereof and a second side frame member mounted to the table top half and disposed along a second edge thereof;

a first table leg having a crossbar rotatably mounted between the first and second side frame members of the first table top half and a second table leg having a crossbar rotatably mounted between the first and second side frame members of the second table top half, wherein each crossbar rotates as the respective table leg is pivoted from an extended position to a stowed position;

a first support member having a first end and a second end, the support member first end being pivotably mounted to the first table leg;

a first hinge member mounted to the first table top half and having a notch for selectively engaging a pawl pin;

a second hinge member mounted to the second table top half and pivotally connected to the first hinge member for pivotally connecting together the table top halves, the second hinge member having a slot configured to receive the pawl pin;

a hinge rod that rotationally connects the first and second hinge members together and extends across the width of the table top halves, wherein the second end of the first support member is pivotably mounted to the hinge rod;

the pawl pin disposed in the slot of the second hinge member and operable to slide in the slot between a first position and a second position, wherein the pawl pin engages the notch of the first hinge member when in the first position, thereby preventing rotation of the first hinge member with respect to the second hinge member, and wherein the pawl pin disengages the notch of the first hinge member when in the second position, thereby allowing rotation of the first hinge member with respect to the second hinge member;

a cable having a first end and a second end, wherein the first end of the cable is secured to a portion of the first table leg and the second end of the cable is secured to the pawl pin, such that moving the first table leg from an extended position to a stowed position causes movement of the second end of the cable, thereby moving the pawl pin from the first position to the second position to disengage the pawl pin from the notch.

2. The assembly of claim 1 further comprising a spring member having spring arms that engage the pawl pin and urge the pawl pin toward the first position.

3. The assembly of claim 1, wherein the first and second hinge members are connected together by a hinge pin.

4. The assembly of claim 1 further comprising:

the first and second hinge members configured for placement adjacent the first edge of the table top halves; and third and fourth hinge members configured for placement adjacent the second edge of the table top halves.

5. The assembly of claim 4 further comprising a hinge rod that rotationally connects the first and second hinge members together, extends across the width of the table top halves, and rotationally connects the third and fourth hinge members.

6. A collapsible table comprising:

a tabletop comprising a first tabletop half and a second tabletop half, the first and second tabletop halves each having a substantially planar top surface, a bottom surface opposite the top surface, an inner edge, and an opposing outer edge which is substantially parallel to the inner edge;

a collapsible leg assembly attached to the bottom surface of each of the tabletop halves, wherein each leg assembly is operable to collapse independently of the other leg assembly and is movable between an extended position and a stowed position, and wherein each leg assembly has a crossbar mounted between side frame members, the crossbar rotating as the respective leg assembly is pivoted from the extended position to the stowed position;

a first and a second support member, each having a first end and a second end, wherein the first end of each support member is pivotably mounted to one of the collapsible leg assemblies; and a locking hinge assembly for pivotally connecting together the first and second table top halves and for automatically disengaging a locking feature of the hinge assembly when at least one of the collapsible leg assemblies is moved from the extended position to the stowed position, the hinge assembly comprising:

a first hinge member having a notch for selectively engaging a pawl pin;

a second hinge member pivotally connected to the first hinge member, the second hinge member having a slot configured to receive the pawl pin;

a hinge rod that rotationally connects the first and second hinge members together and extends across the width of the table top halves, wherein the second end of each of the first and second support members is pivotably mounted to the hinge rod;

the pawl pin having opposite ends and a side surface, the pawl pin disposed in the slot of the second hinge member and operable to slide in the slot between a first position and a second position;

wherein the pawl pin engages the notch of the first hinge member when in the first position, thereby preventing rotation of the first hinge member with respect to the second hinge member; and wherein the pawl pin disengages the notch of the first hinge member when in the second position, thereby allowing rotation of the first hinge member with respect to the second hinge member; and a cable having a first end and a second end, wherein the first end of the cable is secured to a portion of the at least one collapsible leg assembly and the second end of the cable is secured to the pawl pin, such that moving the at least one collapsible leg assembly from an extended position to a stowed position causes movement of the second end of the cable, thereby moving the pawl pin from the first position to the second position to disengage the pawl pin from the notch.

7. The collapsible table of claim 6 further comprising a spring member having spring arms that engage the pawl pin and urge the pawl pin toward the first position.

8. The collapsible table of claim 6 wherein the first and second hinge members are connected together by a hinge pin.

9. The collapsible table of claim 6 further comprising:

the first and second hinge members configured for placement adjacent a first edge of the table top halves; and third and fourth hinge members configured for placement adjacent a second edge of the table top halves.

10. The collapsible table of claim 9 further comprising a hinge rod that rotationally connects the first and second hinge members together, extends across the width of the table top halves, and rotationally connects the third and fourth hinge members.

11. A collapsible table comprising:

a tabletop comprising a first tabletop half and a second tabletop half, the first and second tabletop halves each having a substantially planar top surface, a bottom surface opposite the top surface, an inner edge, and an opposing outer edge which is substantially parallel to the inner edge;

first frame members disposed along a first edge of each of the first and second table top halves and mounted to the bottom surface thereof;

second frame members spaced apart from the first frame members and disposed along a second edge of each of the first and second table top halves and mounted to the bottom surface thereof;

a collapsible leg assembly having a crossbar pivotally mounted between the first and second frame members of each of the first and second table top halves, wherein each leg assembly is operable to collapse independently of the other leg assembly and is movable between an extended position and a stowed position;

a first and a second support member, each having a first end and a second end, wherein the first end of each support member is pivotably mounted to one of the collapsible leg assemblies; and a locking hinge assembly for pivotally connecting together the first and second table top halves and for automatically disengaging a locking feature of the hinge assembly when at least one of the collapsible leg assemblies is moved from the extended position to the stowed position, the hinge assembly comprising:

a first hinge member having a notch for selectively engaging a pawl pin;

a second hinge member having a slot configured to receive the pawl pin;

a third hinge member and a fourth hinge member;

wherein each of the first and second hinge members is secured to one of the first frame members and each of the third and fourth hinge members is secured to one of the second frame members;

a hinge rod for rotationally connecting the first and second hinge members together and for rotationally connecting the third and fourth hinge members together, wherein the second end of each of the first and second support members is pivotably mounted to the hinge rod;

the pawl pin disposed in the slot of the second hinge member and operable to slide in the slot between a first position and a second position;

wherein the pawl pin engages the notch of the first hinge member when in the first position, thereby preventing rotation of the first hinge member with respect to the second hinge member;

wherein the pawl pin disengages the notch of the first hinge member when in the second position, thereby allowing rotation of the first hinge member with respect to the second hinge member;

a spring member having spring arms that engage the pawl pin and urge the pawl pin toward the first position; and a cable having a first end and a second end, wherein the first end of the cable is secured to a portion of the at least one collapsible leg assembly and the second end of the cable is secured to the pawl pin, such that moving the at least one collapsible leg assembly from an extended position to a stowed position causes movement of the second end of the cable, thereby moving the pawl pin from the first position to the second position to disengage the pawl pin from the notch.

* * * * *